United States Patent [19]

Simon

[11] 4,219,311

[45] Aug. 26, 1980

[54] PUMP ASSEMBLY

[75] Inventor: Donald J. Simon, Midland, Tex.

[73] Assignee: Sargent Industries, Inc., Los Angeles, Calif.

[21] Appl. No.: 501,495

[22] Filed: Aug. 29, 1974

[51] Int. Cl.[2] ..... F04B 3/00; F04B 5/00

[52] U.S. Cl. ..... 417/260; 417/454

[58] Field of Search ..... 166/105; 417/251, 259, 417/454, 260

[56] References Cited

U.S. PATENT DOCUMENTS

| | | | |
|---|---|---|---|
| 246,091 | 8/1881 | Davies | 417/259 |
| 1,066,798 | 7/1913 | Conrader | 417/434 |
| 2,148,939 | 2/1939 | Goldsmith | 417/495 |
| 2,173,805 | 9/1939 | Hessman | 417/296 |
| 2,193,020 | 3/1940 | Collins | 417/495 |
| 2,344,787 | 3/1944 | Patterson et al. | 417/503 |
| 2,383,934 | 9/1945 | Crane | 417/260 |
| 2,544,094 | 3/1951 | Knowles | 417/260 |
| 2,563,038 | 8/1951 | Irwin | 166/105 |
| 2,723,625 | 11/1955 | Nichols | 417/259 |
| 3,074,352 | 1/1963 | Vincent | 417/259 |
| 3,136,256 | 6/1964 | Chenault | 417/444 |
| 3,861,471 | 1/1975 | Douglas | 417/435 |
| 4,157,117 | 6/1979 | Huckaby | 417/434 |

*Primary Examiner*—William L. Freeh

*Attorney, Agent, or Firm*—Ellsworth R. Roston

[57] ABSTRACT

A rod-drawn pump for use in a well includes a tubing and a rod reciprocating within the tubing to move a plunger in a series of alternating upward strokes and downward strokes. The plunger defines a pump chamber with a standing valve through which liquid from the well passes during the upward stroke of the plunger. During the downward stroke, the liquid in the pump chamber passes through a traveling valve in the plunger and into a particular cavity defined by the plunger and a third valve. During the next upward stroke, the liquid in the particular cavity passes through the third valve to produce a column of the liquid which is eventually lifted from the well. The third valve supports the column of the liquid during the next downward stroke so that the traveling valve in the plunger is open when it contacts the surface of the liquid in the pump chamber. This inhibits gas and liquid pound during the downward stroke. Portions of the rod at least partially define a passage which bypasses the third valve near the end of the downward stroke to substantially fill the particular cavity prior to the upward stroke. This inhibits any gas or liquid pound which might otherwise result during the upward stroke.

6 Claims, 11 Drawing Figures

11
13
15
17
19
21
23
25
27
29
31
33
35
37

PUMP ASSEMBLY

BACKGROUND OF THE INVENTION

1. Field of the Invention

This invention relates generally to pumps and more specifically to rod-drawn subterranean pumps for use in wells such as oil and water wells.

2. Description of the Prior Art

Subterranean pumping apparatus of the prior art have typically included a cylindrical housing suitable for operational disposition at the bottom of a well, such as an oil well or a water well. In a common type of pumping apparatus, a rod string extends into the pump housing to support a plunger within the housing. The rod string is reciprocated to move the plunger in alternating upward and downward strokes.

A stationary valve, which is typically located at the bottom of the pump, defines with the housing and the plunger, a pump cavity. The stationary valve permits the fluid in the well to enter the pump chamber on the upward stroke of the plunger and inhibits the flow of the fluid from the chamber during the downward stroke of the plunger.

During the upward stroke of the plunger, the standing valve opens to permit gas and liquid from the well to enter the pump chamber. On the downward stroke of the plunger, the gas and liquid in the pump chamber is trapped due to the closing of the standing valve. As the plunger moved downwardly within the housing, the column of fluid in the region above the plunger provides a significant back pressure which maintains the traveling valve within the plunger in a closed state. With both the traveling valve and the stationary valve in a closed state, the downward progression of the plunger compresses the gas within the pump chamber.

At this point, one of two problems has typically occurred in the pumps of the prior art. If the gas in the pocket is compressed to a pressure of sufficient magnitude to overcome the back pressure of the column of fluid on the check valve, the gas in the pocket will create a severe impack on the check valve forcing it to open. This severe impact causes an upward compressive force, commonly referred to as "gas pound, " on the rod string which is particularly damaging to the well equipment.

If the gas enters the pocket at a relatively low pressure, the plunger may effectually reach the surface of the fluid before the check valve in the plunger opens. The resulting impact between the plunger and the liquid in the pump chamber also produces an upward compressive force, commonly referred to as "liquid pound, " on the rod string. The liquid pound is even more damaging than the gas pound since the liquid in the pump chamber is relatively incompressible and hence the magnitude of impact between the plunger and the surface of the liquid is even greater.

In an attempt to overcome this problem, a third valve has been added to the pump. This third valve is typically a "ring" valve which includes a valve housing having a fixed relationship with the housing of the pump. The rod string extends through the valve housing and a ring valve element, which extends circumferentially of the rod string, seats on the valve housing to support the column of fluid above the plunger during the downstroke of the rod string. Since the traveling check valve no longer supports the falling column of the liquid, the back pressure on the traveling valve is significantly reduced. As a result, the traveling valve will typically open during the downward stroke prior to the occurrence of gas pound or liquid pound.

Unfortunately, this two-stage pump has merely transferred the shock load to the upward stroke. At the bottom of the downward stroke, after a portion of the fluid in the pump chamber has passed through the traveling valve in the plunger, said fluid is supported above the plunger and below the third valve. If the plunger and the fluid between the plunger and the third valve are moving upwardly at a relatively high velocity, a severe shock load results when they encounter the closed ring valve and the back pressure provided by the column of fluid above the ring valve. This impact creates a significant tensile strength on the rod string which can be as damaging as the compressive stress previously described.

SUMMARY OF THE INVENTION

The subterranean rod-drawn pump of the present invention does not encounter gas pound or liquid pound during either the upward stroke or the downward stroke. As a result, there are no compressive or tensile impact forces created in the rod string to severely damage the well equipment.

One embodiment of the invention includes the stationary valve, the traveling valve in the plunger and the ring valve defining a particular cavity with the tubing or the pump housing and the plunger. In this embodiment, the rod string extending through the ring valve element has portions which at least partially define a passage bypassing the ring valve element near the bottom of the downstroke. This passage permits a portion of the liquid in the column above the ring valve to substantially fill the particular cavity prior to the upward stroke. Then at the beginning of the upward stroke, the liquid in the substantially filled particular cavity gradually opens the ring valve. Since the velocity of the plunger increases from substantially zero, the force exerted by the liquid in the particular cavity on the ring valve also increases from a magnitude of substantially zero. Thus the ring valve is gradually opened without a significant impact or liquid pound.

The substantial filling of the particular cavity can also be accomplished by providing the rod string with a cavity which extends above and below the ring valve element when the plunger is near the bottom of the downstroke. This cavity can be provided with apertures above and below the ring valve element to provide a passage for substantially filling the particular cavity prior to the upward stroke.

In a further embodiment, the rod string, which passes through a stationary seal above the plunger, is provided with a hollow configuration. In this embodiment, the column of fluid above the pump is supported by a third valve which travels with the plunger at the base of the hollow rod string. This third valve defines the particular cavity with the tubing or the pump housing and the traveling valve in the plunger. During the upward stroke, the fluid which has entered the particular cavity through the traveling valve is forced through the third valve and the hollow rod string to the regions above the stationary seal.

In this particular embodiment, the hollow rod string is provided with an aperture which passes through the stationary seal when the plunger is near the bottom of the downward stroke. This aperture provides a passage through the hollow rod string to provide for the substantial filling of the particular cavity with the liquid in the column above the pump. As in the previous embodiment, this fluid which substantially fills the particular cavity gradually opens the third valve at the beginning of the upward stroke so that there is no severe fluid impact on the third valve or the stationary seal.

This embodiment including a stationary seal and a movable third valve can include a rod string having a restricted portion as described with the initial embodiment to provide for the filling of the particular cavity.

These rod drawn pumps are of particular advantage for use in wells such as water and oil wells. The severe impacts commonly associated with gas and fluid pound in the pumps of the prior art do not occur in the pumps of the present invention. As a result, there is no severe impact on the rod string which can severely damage the well equipment.

These and other features and advantages of the present invention will become more apparent with a description of preferred embodiments discussed with reference to the associated drawings.

DESCRIPTION OF PREFERRED EMBODIMENTS

Figures 1, 2, 3, 4, 5:
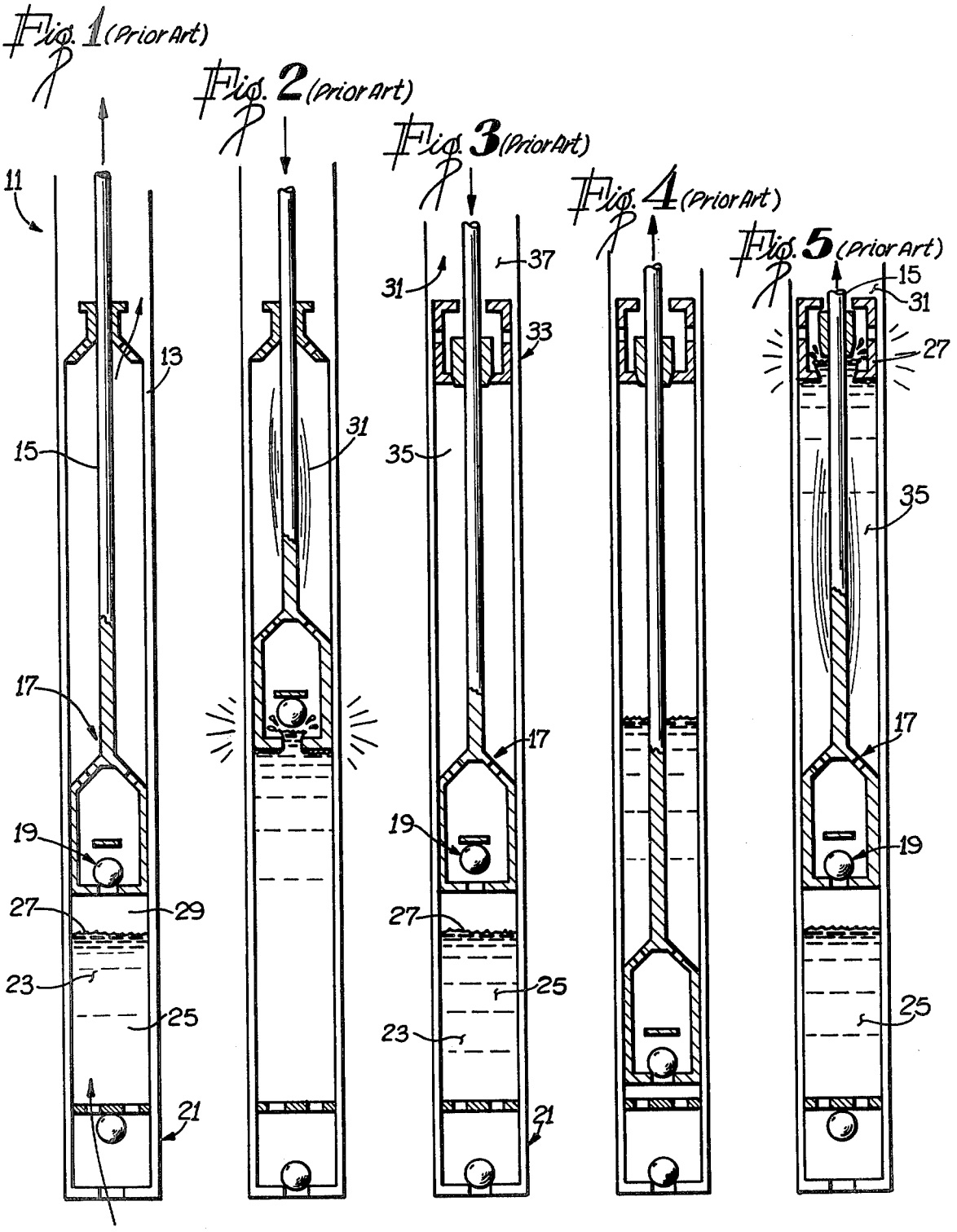
Fig. 1 (Prior Art)
Fig. 2 (Prior Art)
Fig. 3 (Prior Art)
Fig. 4 (Prior Art)
Fig. 5 (Prior Art)
FIG. 1 is a side elevational view in axial cross section of a rod-drawn subterranean pump of the prior art, the pump including a rod string for reciprocating a plunger and the plunger being illustrated at a median position during the upstroke.
FIG. 2 is a side elevational view in axial cross section of the pump illustrated in FIG. 1 wherein the plunger is shown at the moment of impact with the liquid beneath the plunger to produce "liquid pound" during the downstroke.
FIG. 3 is a side elevational view in axial cross section of a further pump of the prior art having a third valve defining with the plunger a particular cavity, the plunger being shown during the downstroke and immediately prior to impact with the liquid below the plunger.
FIG. 4 is a side elevational view in axial cross section of the pump illustrated in FIG. 3 wherein the plunger is shown at the beginning of the upstroke with a partially filled cavity above the plunger and below the third valve.
FIG. 5 is a side elevational view in axial cross section of the pump illustrated in FIG. 3 wherein the plunger is shown during the upstroke at the moment when the liquid in the particular cavity strikes the third valve resulting in "liquid pound; "

Submersible pumps are commonly used to withdraw fluids from wells such as water wells and oil wells. Typical of these submersible pumps is the rod-drawn pump assembly shown generally at 11 in FIG. 1. The pump assembly 11 includes a cylindrical tubing or pump housing 13 and a rod string 15 which is positioned axially of the tubing or housing 13 for reciprocating movement therein. A plunger 7, which is connected to the rod sting 15, is reciprocated by the rod string 15 in a series of alternating upward strokes and downward strokes. The rod string 15 and the plunger 17 may be considered as "control means". A traveling valve 19 which is typically provided at the base of the plunger 17 also reciprocates with a rod string 15. A standing valve 21 is typically provided near the bottom of the housing 13 and defines with the traveling valve 19 a pump chamber 23.

Operation of this pump assembly 11 of the prior art can begin with the upward stroke of the rod string 15 and plunger 17 as illustrated in FIG. 1. During this upward stroke, a liquid 25 having a surface 27, and a gas 29 are drawn through the open standing valve 21 into the pump chamber or region 23. During the downstroke, the plunger 17 is forced by the rod string 15 beneath the surface 27 of the liquid 25 so that the fluid 25 in the chamber 23 passes through the traveling valve 19 into the regions above the plunger 17. This fluid then forms a cavity or region or column 31 within the well, a portion of which is raised above the surface of the well during the next upward stroke of the plunger 17.

Of particular importance to the present invention is the severe impact which has resulted when the plunger 17 has been moved into proximity with the surface 27 of the liquid 25 during the downward stroke. It will be noted that during this downward stroke, the colum 31 of the liquid 25 above the plunger 17 is moving downwardly in a large mass and at a relatively high velocity. This column 31 exerts a substantial back pressure on the traveling valve 19 in the plunger 17. If the gas 29 was drawn into the chamber 23 at a high pressure, the movement of the plunger 17 and the column 31 of the fluid 25 downwardly will compress the gas 29 until its pressure becomes sufficient to pound the valve 19 into an open state. This occurrence is commonly referred to as "gas pound." More typically, the gas 29 in the chamber 23 will occur at a relatively low pressure so that the valve 19 will not open until it contacts the surface 27 of the relatively incompressible liquid 25 as shown in FIG. 2. This occurrence which slams the traveling valve 19 into an open state is commonly referred to as "liquid pound." Both the gas pound and liquid pound result in severe shocks to the pump assembly 11 and other well appartus.

Attempts have been made to reduce the magnitude of the back pressure on the traveling valve 19 in order to facilitate the opening of the valve 19 during the downward stroke. In an apparatus such as that illustrated in FIG. 3, a ring valve shown generally at 33 has been positioned within the housing 13 above the plunger 17. Thus the ring valve 33 and the plunger 17 have defined with the housing 13 a particular cavity or region 35. The ring valve 33 functions as a check valve to permit the flow the liquid 25 from the particular cavity 35 into a cavity or region 37 above the ring valve 33. This flow of the liquid 25 in the upward direction occurs during the upstroke of the plunger 17.

During the downward stroke, the ring valve 33 inhibits flow of the liquid 25 from the region 37 into the particular cavity or region 35. Thus the weight of the column 31 of the liquid 25 is primarily supported by the ring valve 33. This significantly reduces the back pressure on the traveling valve 19 in the plunger 17. Essentially this means that in the particular cavity 35 a gas pressure of significantly reduced magnitude permits opening of the traveling valve 19 by increasing gas pressure within the chamber 23. Thus, during the downward stroke of the plunger 17 the traveling valve 19 can be opened as shown in FIG. 3 so that when the plunger 17 contacts the surface 27 of the liquid 24 in the pump chamber 23, there is substantially no fluid or gas pound.

Unfortunately, the high impact and resulting shock, heretofore associated with the downward stroke, is merely transferred to the upward stroke. After the plunger 17 has passed beyond the surface 27 and has begun the upward stroke as shown in FIG. 4, the surface 27 is raised by the plunger 17 upwardly toward the ring valve 33. It will be recalled that this ring valve 33 is in a closed state due to the significant back pressure of the colum 31 of the liquid 25 in the region 37. As the surface 27 is raised during the upstroke, it eventually slams into the ring valve 33. Only after significant tensile stresses have been exerted upon the rod string 15 and other shock loads have occurred throughout the apparatus 11 is the valve 33 opened to permit the fluid 25 to pass through the valve 33 and into the region or cavity 37.

It can be seen that in each of these embodiments of the prior art, the gas pound or liquid pound has occurred as a result of a fluid surface moving at a high velocity relative to a closed valve to create an impact on a valve which opens the valve. The magnitude of the shock on the system is even more severe where the valve is maintained in a closed state by a significant back pressure such as that typically associated with a column of the liquid. If the column of liquid is moving with the valve, the shock is even further increased by the momentum of the moving column of liquid.

Each of the pumps described below has features which inhibit both the gas pound and liquid pound in both the upward stroke and the downward stroke. Thus the pumps are not subjected to these significant impacts which produce the damaging shock loads. The pumps described below include some of the elements previously described with reference to the pumps of the prior art. These similar elements will be designated with the same reference numerals followed by a lower case letter, such as the letter "a."

Figure 6:
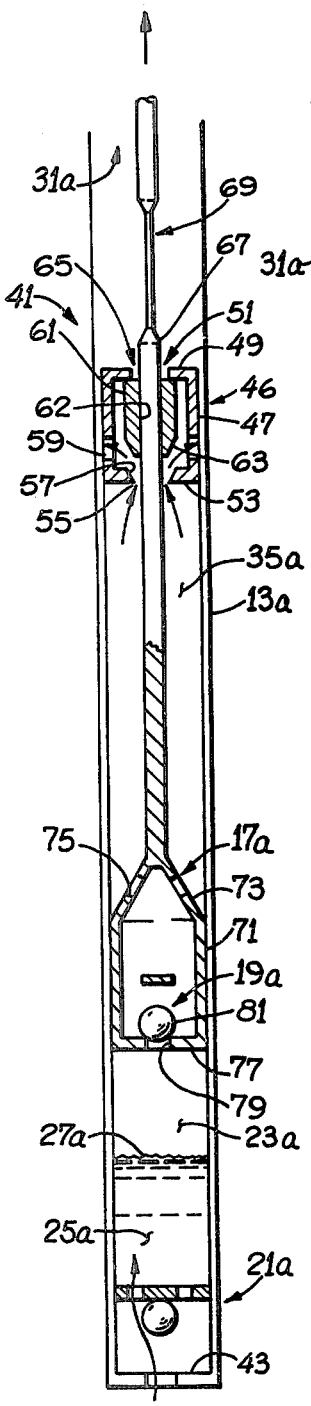
FIG. 6 is a side elevational view in axial cross section of a pump of the present invention including a stationary valve, a traveling valve, a third valve, and a rod string having restricted portions.

One embodiment of a pump assembly 41 of the present invention is illustrated in FIG. 6. This pump assembly 41 includes a pump housing **13*a* which has a generally cylindrical configuration adapted to be positioned in the bore of a well such as an oil well. A standing valve 21*a* is disposed near the bottom of the housing 13*a* and a ring valve 46 is disposed near the top of the housing 13*a*. A plunger 17*a* is positioned for reciprocal movement between the valves 21*a* and 46. Thus the plunger 17*a* defines with the standing valve 21*a* a pump chamber 23*a* and defines with the ring valve 46 a particular cavity or region 35*a***.

The stationary valve **21*a* can be of the common check valve variety, including a valve seat 43 and a valve element 45 positioned on the upward side of the valve seat 43. With this configuration, the valve 21*a* permits the upward flow of the liquid 25*a* from the well and into the pump chamber 23*a*. Downward flow of the liquid from the chamber 23*a* to the well is inhibited however when the valve element 45 forms a seal with the valve seat 43**.

In a preferred embodiment, the ring valve 46 has a valve housing 47 including shoulders 49 which define an opening 51 at the top of the housing 47, and shoulders 53 which define an opening 55 and a valve seat 57 at the bottom of the housing 47. In addition, the housing 47 includes portions which define openings 59 which extend through the walls of the housing 47. A ring valve element 61 is disposed between the shoulders 49 and 53 of the housing 47. The ring valve element 61 includes portions which define a surface 63 which is shaped to register with the valve seat 57 formed by the shoulders 53. Further portions 62 of the valve ring element 61 define a longitudinal hole 65 which extends axially of the pump assembly 41.

In this embodiment, a rod string 67 extends axially of the pump assembly 41 through the opening 65 in the ring valve element 61 and through the openings 51 and 55 in the valve housing 47. The rod string 67 in the preferred embodiment has a configuration of a cylinder over most of its length. The outside diameter of this cylinder is substantially the inside diameter of the opening 65 so that the rod string 67 forms a seal with the ring valve element 61 over most of the length of the rod string 67. In this particular embodiment, the rod string 67 includes restricted portions, shown generally at 69, which have a cross-sectional area which is less than that of the opening 65 in the ring valve element 61. When these restricted portions 69 of the rod string 67 move into proximity to the ring valve 46 they do not form a seal with the ring valve element 61. This structure is of particular advantage to the present invention for reasons discussed below.

The plunger **17*a* is defined by walls 71 which extend into close proximity to the housing 13*a*, and shoulders 73 which extend from the walls 71 for connection to the rod string 67. These shoulders 73 are provided with holes 75 which extend between the particular cavity or region 35*a* and the regions interior of the plunger 17*a*. Shoulders 77 also extend from the wall 71 near the bottom of the plunger 17*a* to define an opening 79. These shoulders 77 also function as a valve seat for cooperation with a valve element 81 to define a traveling 19***a* in the plunger 17*a*.

Figure 7:
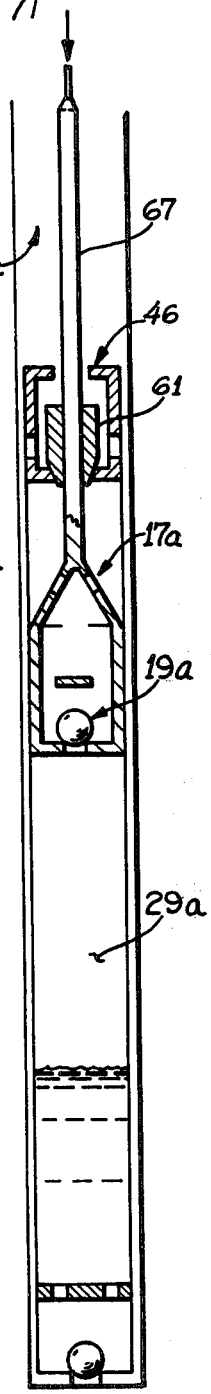
FIG. 7 is a side elevational view in axial cross section of the pump illustrated in FIG. 6 wherein the plunger is shown at the beginning of the downward stroke.

The operation of the pump assembly 41 typically begins with the rod string 67 and the attached plunger 17*a* moving in an upward direction through the housing 13*a*. With this movement, a suction is created in the pump chamber 23*a* which closes the traveling valve 19*a* and opens the stationary valve 21*a*. With the opening of the valve 21*a*, gas 29*a* and liquid 25*a* enter the pump chamber 23*a* until the plunger 17*a* moves into close proximity of the ring valve 46 as shown in FIG. 7.

After several reciprocating movements of the plunger 17*a*, a column 31*a* of the liquid 25 forms above the traveling valve 19*a*. That portion of the column 31*a* which is disposed beneath the ring valve 46 is forced upwardly through the ring valve 46 during the upward stroke of the plunger 17*a*. Thus, this portion of the liquid 25 is pushed through the openings 55 and 59 in the valve housing 47 and into the regions above the ring valve 46.

Figure 8:
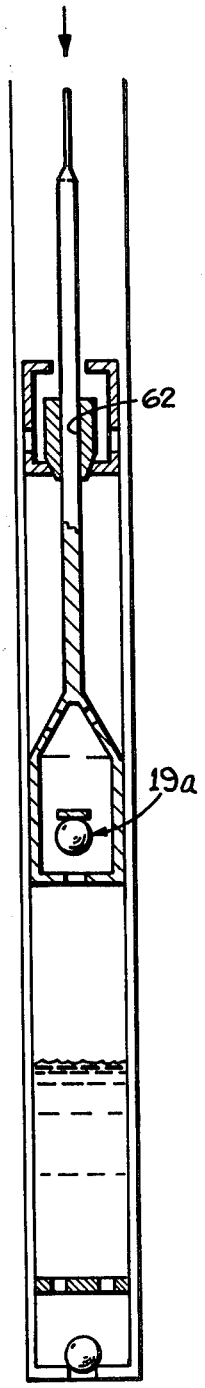
FIG. 8 is a side elevational view in axial cross section of the pump illustrated in FIG. 6 with the plunger shown immediately prior to impact with the liquid below the plunger.
Figure 9:
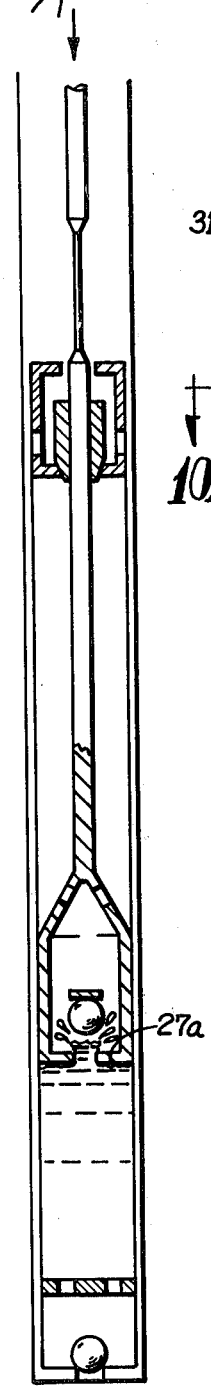
FIG. 9 is a side elevational view in axial cross section of the pump illustrated in FIG. 6 during the downward stroke, with the plunger shown at the moment of impact with the liquid below the plunger.

At the completion of the upward stroke, the gas 29*a* and liquid 25*a* cease to enter the chamber or cavity or region 23*a* and the weight of the fluid 25*a* closes the stationary valve 21*a*. As the plunger 17*a* begins it downward stroke as illustrated in FIG. 7, the ring valve element 61 will fall due to the weight of the column 31*a* and due to the friction of the element 61 against the cylindrical portions of the rod string 67. Thus the ring valve element 61 will seat on the valve seat 57 to support substantially all of the column or cavity or region 31*a* above the ring valve 46. As the plunger 17*a* continues the downward stroke, there will be relatively little back pressure on the traveling valve 19*a*. As a result, the gas 29*a* in the pump chamber or region 23*a* will be compressed to open the traveling valve 19*a* as shown in FIG. 8. Once the traveling valve 19*a* is open, the contact of the plunger 17*a* with the surface 27*a* as shown in FIG. 9 will not produce the severe shock commonly referred to as liquid pound.

Of particular importance to the present invention is the further movement of the rod string 67 and plunger 17*a* beneath the surface 27*a*. This movement initially provides for the flow of the liquid 25*a* from the pump chamber or cavity or region 23*a* through the traveling valve 19*a*, the opening 75, and into the particular cavity or region 35*a*. Further movement of the rod string 67 and the plunger 17*a* beneath the surface 27*a* eventually brings the restricted portions 69 of the rod string 67 into adjacent relationship with the ring valve element 61 in the ring valve 46. As previously noted, these restricted portions 69 do not form a seal with the portions 62 of the element 61 which define the opening 65. Rather, the restricted portions 69 form a passage with the portions 62 of the ring valve element 61 so that a portion of the liquid 25*a* in the column 31*a* flows into the particular cavity or region 35*a*. The length of the restricted portion 69 and the difference in the cross-sectional areas of the restricted portion 69 and the opening 65 control the rate at which the liquid 25*a* passes into the particular cavity 35*a*. These dimensions can be adjusted so that the cavity 35*a* is substantially filled with the liquid 25*a* prior to the upward stroke.

Figure 10:
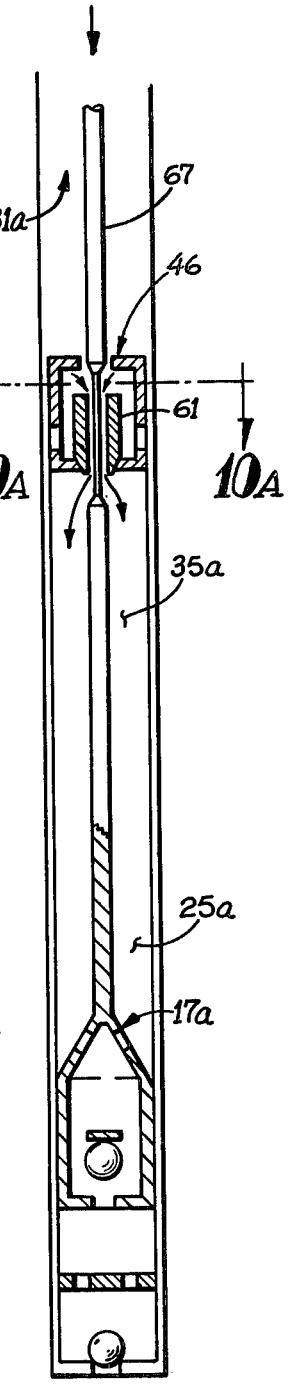
FIG. 10 is a side elevational view in axial cross section of the pump illustrated in FIG. 6 wherein the restricted portions of the rod string at least partially define a passage between the regions above the third valve and a particular cavity below the third valve to substantially fill the particular cavity with liquid.
Figure 10A:
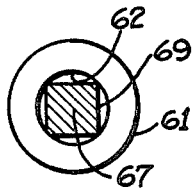
FIG. 10*a* is a cross-sectional view of the rod string taken on line 10*a*–*10a* of FIG. 10.

In a preferred embodiment, the restricted portions 69 of the rod string 67 have in radial cross section the general configuration of a square, as shown in FIG. 10*a*. The corners of the square are rounded to contact the portions 62 of the ring valve element 61 which define the opening 65. The sides of the square are displaced from the portion 62 of the ring valve element 61 so that they form the passage through which the liquid 25*a* in the column 31*a* flows into the particular cavity or region 35*a*. This configuration is desirable since it maintains the alignment of the rod string 67 and the ring valve element 61 even at the restricted portion 69. Numerous other restrictive configurations can be utilized to achieve this preferred result.

When the upward stroke of the plunger 17*a* begins, the liquid 25*a* in the substantially filled particular cavity or region 35*a* gradually forces the ring valve element 61*a* upwardly away from the valve seat 57. As compared to the prior art pump illustrated in FIG. 5, with the present pump there is substantially no impact resulting from a column of liquid moving upwardly against a closed valve. Rather, the liquid in the cavity 35*a* is already in contact with the ring valve 46 so that the upward velocity of the liquid in the cavity 35*a* gradually increases as the velocity of the plunger 17*a* increases. Thus, with the present invention there is substantially no gas or liquid pound associated with either the downward stroke of the upward stroke.

Figure 11:
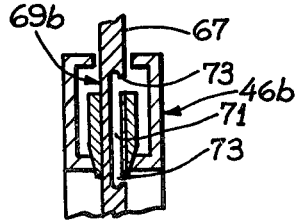
FIG. 11 is a side elevational view in cross section of the pump illustrated in FIG. 6 wherein the passage which facilitates the substantial filling of the particular cavity is formed by a hollow rod string.
Figure 12:
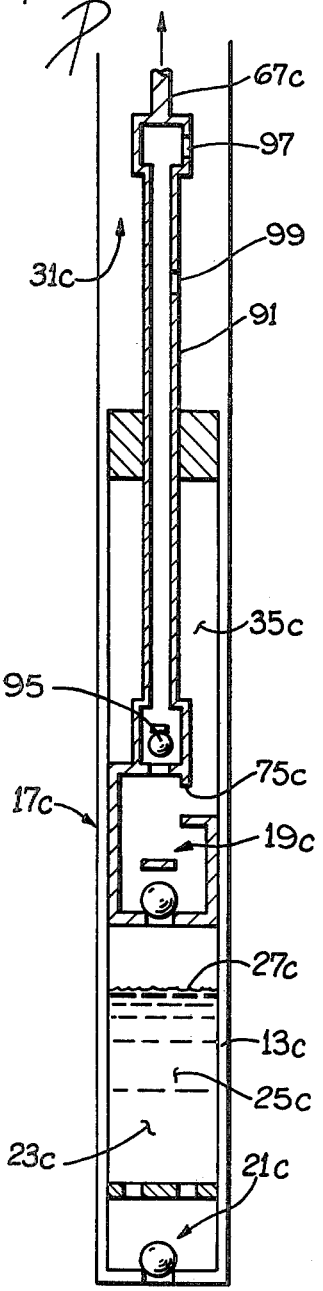
FIG. 12 is an axial cross-sectional view of a further embodiment of the pump of the present invention including a hollow rod string, a stationary seal and a particular check valve which defines with the traveling valve the particular cavity, the plunger being shown in the upward stroke.

FIG. 11 illustrates a further embodiment of the invention similar to the embodiment of FIG. 6 wherein the rod string 67 has a substantially constant diameter along its entire length. However, a portion of the rod string 67 shown generally at 69*b* is hollowed to define a cavity 71 interiorly of the rod string 67. At least a pair of holes 73 extend through the rod string 67 into the cavity 71. It is desirable that these holes 73 be axially spaced along the rod string 67 a distance greater than the axial length of the ring valve element 61. Then, when the portion 69*b* of the rod string 67 moves into adjacent relationship with the ring valve element 61, the liquid 25*a* in the column 31*a* will bypass the valve 46*a* by flowing through the passage defined by the holes 73 in the cavity 71. Thus, this embodiment provides another means for filling the particular cavity 35*a* prior to the upward stroke to inhibit the gas pound and liquid pound associated with the pumps of the prior art.

In a further embodiment of the invention, the pump housing 13*c*, standing valve 21*c*, and traveling valve 19*c* are similar to those previously discussed. The plunger 17*c* and the associated opening 75*c* into the particular cavity 35*c* are also similar to those of the previous embodiment. The primary differences of this embodiment of the invention are associated with the rod string 67*c* together with the valves and seals which function in a manner similar to those of the ring valve 46.

In this specific embodiment, the rod string 67*c* has the configuration of a hollow tube 91 at its lowermost portion. A stationary seal 93, which has a fixed relationship with the pump housing 13*c*, forms a running seal with the outer surface of the hollow tube 91. Stationary seal 93 is preferably positioned above the plunger 17*c* so that it defines with the plunger 17*c* the particular cavity 35*c*. The plunger 17*c* also defines with the standing valve 21*c* the pump chamber 23*c*.

At the bottommost portions of the hollow tube 91, a check valve 95 is provided to control the flow of the liquid 25*c* between the housing of the plunger 17*c* and the hollow tube 91. Since the housing of the plunger 17*c* communicates with a particular cavity 35*c* through the opening 75*c*, the check valve 95 also controls the flow of the liquid 25*c* between the hollow tube 91 and the particular cavity 35*c*.

The hollow tube 91 is provided with a pair of openings 97 and 99 which are axially spaced along the tube 91 a distance greater than the axial length of the stationary seal 93. In a preferred embodiment, the opening 97 remains above the stationary seal 93 during a major portion of both the upward stroke and the downward stroke. However, it is desirable that the opening 99 pass through the stationary seal 93 as the plunger 17c approaches the bottom of the downward stroke. With the opening 97 above the seal 93 and the opening 99 below the seal 93, a passage is formed through the hollow tube 91 which bypasses the seal 93. The passage provides a means by which a particular cavity 35c is substantially filled with a portion of the liquid in the column 31c prior to the upstroke of the plunger 17c.

Figure 13:
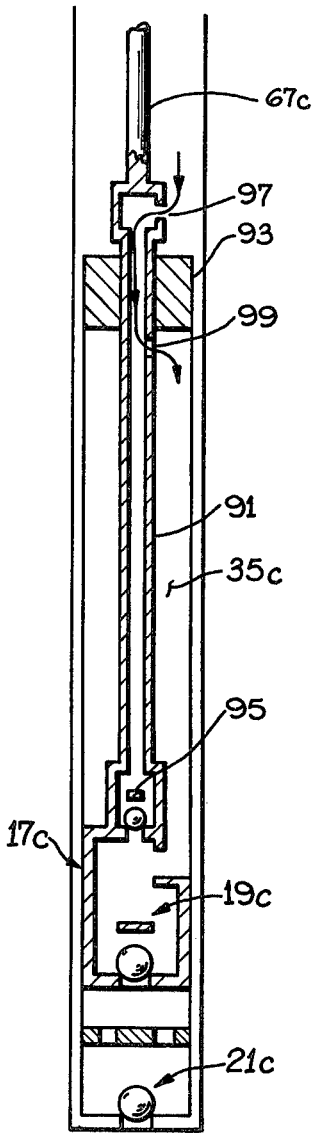
FIG. 13 is an axial cross-sectional view of the pump illustrated in FIG. 12 wherein the plunger is shown in the downward stroke and the hollow rod string is provided with an aperture to provide a passage for substantially filling the particular cavity with the liquid in the column above the pump.

During the downward stroke of the plunger 17c, a portion of the liquid 25c in the pump chamber 23c flows through the traveling valve 19c and through the opening 75c into the particular cavity 35c. During this downstroke, the valve 95 at the base of the tube 91 maintains a closed state due to the substantial pressure of the liquid 25c in the column 31c which provides a back pressure on the valve 95 through the tube 91. Near the end of the downward stroke, the opening 99 passes through the stationary seal 93 to define with the opening 97 a passage between the liquid column 31c and a particular cavity 35c. This enables a portion of the liquid in the column 31c to enter the particular cavity and thereby substantially fill the particular cavity 35c prior to the upward stroke of the plunger 17c as shown in FIG. 13.

During the upstroke, the volume of the particular cavity 35c is decreased so that the liquid in the cavity 35c exerts a back pressure upon the traveling valve 19c and a forward pressure on the check valve 95. When this forward pressure exceeds the back pressure on the valve 95 created by the liquid 25a in the column 31c, the check valve 95 opens and the fluid in the particular cavity 35 flows through the opening 75c, the valve 95 and the openings 97 and 99 into the region or cavity above the stationary seal 93.

At the beginning of the downward stroke the weight of the column is supported primarily by the valve 95. Thus the column of liquid 31c exerts substantially no backward pressure upon the traveling valve 19c in the plunger 17c. As the plunger 17c moves downwardly, the volume of the particular cavity 35c increases so that the pressure within the cavity 35c decreases. This enables the traveling valve 19c to open prior to contacting the liquid 25c in the pump chamber 23c. As previously noted, the opening of the traveling valve 19c prevents the occurrence of any gas pound of fluid pound during the downward stroke. Furthermore, due to the substantial filling of the particular cavity 35c near the end of the downward stroke, the gas pound and fluid pound are also avoided in the upward stroke.

Although the invention has been described with reference to specific embodiments, including rod strings 67 having both hollow and restricted portions, it will be apparent that the pumps can be otherwise embodied to overcome the gas pound and fluid pound characteristics associated with the pumps of the prior art. For these reasons, the scope of the invention should be ascertained only with reference to the following claims.

I claim:

1. A valve combination adapted for use in a subterranean pump including a pump housing and supporting a column of fluid movable to a relatively high position within the housing and movable to a relatively low position in the housing, comprising:

a rod movable with alternating upstrokes and downstrokes within the pump housing and providing for a movement of the fluid to a relatively high position within the housing with the upstroke of the rod and providing for a movement of the fluid to a relatively low position within the housing with the downstroke of the rod;

a valve tubing disposed within the pump housing and having an opening for the passage of fluid;

a plunger movable with the rod within the tubing in the alternating upstrokes and downstrokes;

a valve member disposed within the valve tubing at a position beneath the surface of the column in the relatively high position of the column and above the surface of the column in the relatively low position of the column and movable within the valve housing between first and second positions;

portions of the valve member defining with the valve tubing a valve seat extending circumferentially of the rod within the housing and defining a closed relationship with the valve tubing and the rod in the first position of the valve member and defining an open relationship with the valve member and the rod in the second position of the valve member to provide for the passage of fluid through the space between the valve member and the valve tubing and through the opening in the valve housing, the valve member being constructed to be in the first position during substantially all of the downstroke of the rod and to be in the second position during substantially all of the upstroke of the rod; and a valve element formed on the rod and disposed circumferentially of the valve seat and movable with the rod between first and second positions and the rod having a closed relationship with the valve member at all positions of the rod during the downstroke of the rod except positions approaching the bottom position of the rod and the valve element of the rod being movable into an open relationship with the valve member at the positions approaching the bottom position of the rod and for substantially the remainder of the downward movement of the rod to provide for a movement of the fluid downwardly from a position above the valve member to a position below the valve member during such open relationship between the valve element and the valve member and to provide for a passage of fluid upwardly from a position below the valve member to positions above the valve member during substantially all of the upward movement of the rod.

2. The valve recited in claim 1 wherein the rod has first portions with a first thickness and the valve element on the rod has a second thickness less than the first thickness and the first portions of the rod define the closed relationship with the valve member and the valve element defines the open relationship with the valve member at the positions near the end of the downward stroke of the rod and for substantially the remainder of the downward stroke of the rod.

3. A pump as recited in claim 1 wherein the rod is hollow and the valve element formed on the rod includes first and second openings spaced along the length of the rod to be disposed respectively above and below the valve member at positions near the end of the downward stroke of the rod and for substantially the remainder of the downward stroke of the rod.

4. A pump adapted to move a fluid from a first elevation to a second, higher elevation, including:

a hollow tubing disposed in a particular direction having a major vertical component;

control means including a rod disposed within the tubing and in the particular direction and having properties for being reciprocated in the particular direction relative to the tubing to produce alternating upward and downward strokes;

the control means including plunger means having a fixed relationship with the rod and being reciprocated by the rod within the tubing relative to the tubing in the particular direction;

first valve means included in the control means and having characteristics for providing for a flow of the fluid upwardly from a region below the plunger means to a region above the plunger means during substantially all of the downward stroke of the plunger means relative to the tubing and for inhibiting the flow of the fluid downwardly from the region above the plunger means to the region below the plunger means during substantially all of the upward stroke of the plunger means relative to the tubing;

second valve means disposed within the tubing above the first valve means and defining with the tubing and the plunger means a first particular cavity which increases in size during the downward stroke of the plunger means relative to the tubing and decreases in size during the upward stroke of the plunger means relative to the tubing, the second valve means being cooperative with the control means for inhibiting the flow of the fluid downwardly from a region above the second valve means into the first particular cavity during substantially all of the downward stroke of the plunger means relative to the tubing and for initially providing for the flow of the fluid downwardly from the region above the second valve means into the first particular cavity near the end of the downward stroke of the plunger means relative to the tubing and for thereafter providing for the flow of fluid downwardly from the region above the second valve means into the first particular cavity for substantially the remainder of the downward stroke of the plunger means relative to the tubing and for providing for a transfer of fluid from the first particular cavity into the region above the first particular cavity during substantially all of the upward stroke of the plunger means relative to the tubing; and third valve means disposed within the tubing at an elevation below the first elevation and defining a second particular cavity with the plunger means and having a fixed relationship and providing for the flow of fluid upwardly into the second particular cavity during the upward movement of the rod relative to the tubing and for inhibiting the downward flow of the fluid from the second particular cavity during the downward stroke of the rod relative to the tubing, the rod being solid and having a portion of reduced thickness providing a communication through the second valve means between the region above the second valve means and the first particular cavity to provide for substantial filling of the first particular cavity by the fluid in the region above the second valve means near the end of the downward stroke of the control means relative to the tubing and for substantially the remainder of the downward stroke of the control means relative to the tubing.

5. A pump for moving fluid from a relatively low elevation to a relatively high elevation without fluid pound, including, a hollow tubing extending from a position below the relatively low elevation to the relatively high elevation;

a rod reciprocatable within the tubing between the relatively low elevation and the relatively high elevation;

plunger means reciprocatable with the rod within the tubing;

first valve means disposed in the tubing at a first particular position below the relatively low elevation for facilitating the flow of fluid upwardly to the relatively high elevation during substantially all of the upstroke of the rod and for preventing the flow of fluid downwardly below the first valve means during substantially all of the downstroke of the rod;

second valve means disposed in the tubing above the first valve means and included with the plunger means and movable with the rod and the plunger means for providing for the flow of fluid upwardly to a position above the plunger means during substantially all of the downstroke of the rod and for the lifting of such fluid with the plunger means during substantially all of the upstroke of the rod and for preventing the flow of fluid downwardly below the second valve means during the upstroke of the rod; and third valve means disposed in the tubing at a second particular position above the second valve means and having open and closed conditions and including means cooperative with the rod during the downstroke of the rod to remain closed during the downstroke of the rod and to become opened near the end of the downstroke of the rod and for substantially the remainder of the downstroke of the rod to provide for the flow of fluid from a position above the third valve means to a position above the plunger means near the end of the downstroke of the rod and for substantially the remainder of the downstroke of the rod, thereby to minimize the fluid pound in the third valve means during the upstroke of the rod, and to become opened during the upstroke of the rod to provide for a transfer of fluid from a position above the plunger means to a position above the third valve means during all of the upstroke of the rod, thereby to minimize fluid pound in the second valve means during substantially all of the downstroke of the rod, the third valve means including a valve housing disposed in the tubing at the second particular position and the first means in the third valve means including a valve member movable to a position displaced from the valve housing during substantially all of the upstroke of the rod and movable to a position defining a closure with the valve housing during substantially all of the downstroke of the rod to minimize fluid pound on the second valve means during substantially all of the downstroke of the rod, the second means in the third valve means being disposed on the rod and being positioned relative to the third valve means to provide for a passage of fluid to a position between the second and third valve means from a position above the third valve means near the end of the downstroke of the rod and for substantially the remainder of the downstroke of the rod to minimize fluid pound on the third valve means during substantially all of the upstroke of the rod and to provide for the passage of fluid to a position above the third valve means during substantially all of the upstroke of the rod, the rod being hollow and the second means constituting a pair of apertures disposed at spaced positions along the rod to provide for a flow of fluid from a position above the third valve means through the hollow rod to a position between the second and third valve means near the end of the downstroke of the rod and for substantially the remainder of the downstroke of the rod.

6. A pump for moving fluid from a relatively low elevation to a relatively high elevation without fluid pound, including, a hollow tubing extending from a position below the relatively low elevation to the relatively high elevation;

a rod reciprocatable within the tubing between the relatively low elevation and the relatively high elevation;

plunger means reciprocatable with the rod within the tubing;

first valve means disposed in the tubing at a first particular position below the relatively low elevation for facilitating the flow of fluid upwardly to the relatively high elevation during substantially all of the upstroke of the rod and for preventing the flow of fluid downwardly below the first valve means during substantially all of the downstroke of the rod;

second valve means disposed in the tubing above the first valve means and included within the plunger means and movable with the rod and the plunger means for providing for the flow of fluid upwardly to a position above the plunger means during substantially all of the downstroke of the rod and for the lifting of such fluid with the plunger means during substantially all of the upstroke of the rod and for preventing the flow of fluid downwardly below the second valve means during the upstroke of thr rod; and third valve means disposed in the tubing at a second particular position above the second valve means and having open and closed conditions and including means cooperative with the rod during the downstroke of the rod to remain closed during the downstroke of the rod and to become opened near the end of the downstroke of the rod and for substantially the remainder of the downstroke of the rod to provide for the flow of fluid from a position above the third valve means to a position above the plunger means near the end of the downstroke of thr rod and for substantially the remainder of the downstroke of the rod, thereby to minimize fluid pound in the third valve means during the upstroke of the rod, and to become opened during the upstroke of the rod to provide for a transfer of fluid from a position above the plunger means to a position above the third valve means during all of the upstroke of the rod, thereby to minimize fluid pound in the second valve means during substantially all of the downstroke of the rod, the third valve means including a valve housing disposed in the tubing at the second particular position and the first means in the third valve means including a valve member movable to a position displaced from the valve housing during substantially all of the upstroke of the rod and movable to a position defining a closure with the valve housing during substantially all of the downstroke of the rod to minimize fluid pound on the second valve means during substantially all of the downstroke of the rod, the second means in the third valve means being disposed on the rod and being positioned relative to the third valve means to provide for a passage of fluid to a position between the second and third valve means from a position above the third valve means near the end of the downstroke of the rod and for substantially the remainder of the downstroke of the rod to mimimize fluid pound on the third valve means during substantially all of the upstroke of the rod and to provide for the passage of fluid to a position above the third valve means during substantially all of the upstroke of the rod, the second means constituting a portion of the rod with a thickness less than that on the remainding portions of the rod.

* * * * *